US007195251B2

(12) United States Patent
Walker

(10) Patent No.: US 7,195,251 B2
(45) Date of Patent: Mar. 27, 2007

(54) ITEM OF FOOTWEAR

(75) Inventor: John Graeme Walker, Morpeth (GB)

(73) Assignee: Automation Conveyors Ltd., Northumberland (GB)

( * ) Notice: Subject to any disclaimer, the term of this patent is extended or adjusted under 35 U.S.C. 154(b) by 166 days.

(21) Appl. No.: 10/983,773

(22) Filed: Nov. 8, 2004

(65) Prior Publication Data

US 2005/0121862 A1 Jun. 9, 2005

(30) Foreign Application Priority Data

Nov. 12, 2003 (GB) ..... 0326400.9
Dec. 18, 2003 (GB) ..... 0329335.4

(51) Int. Cl.
*A63C 17/08* (2006.01)

(52) U.S. Cl. ..... 280/11.19; 280/7.13; 36/115

(58) Field of Classification Search ..... 280/11.19, 280/11.24, 11.27, 841, 7.1, 7.12, 7.13, 9; 36/115

See application file for complete search history.

(56) References Cited

U.S. PATENT DOCUMENTS 5,398,970 A * 3/1995 Tucky ..... 280/841
5,785,327 A * 7/1998 Gallant ..... 280/11.27
6,394,468 B1 * 5/2002 Chiang et al. ..... 280/11.223
6,450,508 B1 * 9/2002 Chu ..... 280/11.208
6,629,698 B2 * 10/2003 Chu ..... 280/11.19
6,913,270 B2 * 7/2005 Wang ..... 280/11.24
6,926,289 B2 * 8/2005 Wang ..... 280/7.13

* cited by examiner

*Primary Examiner*—Christopher P. Ellis
*Assistant Examiner*—Brian Swenson
(74) *Attorney, Agent, or Firm*—Pearne & Gordon LLP

(57) ABSTRACT

The item of footwear (10) is provided with a roller (50) to enable the item of footwear to roll over a surface when the rolling means is in a first active position. The item of footwear (10) has a slide yoke (34) for retracting the roller (50) to a second latent position, thereby disabling the roller and preventing the item of footwear from rolling over a surface (see FIG. 2).

14 Claims, 4 Drawing Sheets

ITEM OF FOOTWEAR

BACKGROUND TO THE INVENTION

The present invention relates to an item of footwear, and is particularly concerned with a wheeled shoe for recreation.

In a known wheeled shoe, a wheel may be housed in the heel of a specially adapted shoe. The wheel must be inserted and fitted into the heel of the shoe prior to use as a wheeled shoe for recreation, and the wheel must be removed entirely from the shoe when not in such use. The user is provided with a removal tool to remove the wheel from the shoe. In this way, the shoe is converted from a first state, whereby the shoe in combination with the wheel facilitates the foot of a wearer to roll across a road surface or similar, to a second state, whereby the shoe is made suitable for walking as would be considered normal. A heel plug is provided to replace the wheel when the shoe is converted into the second state. To convert wheeled shoes of this type from the second state to the first state, it is necessary to remove the wheel from the shoe using a removal tool. This causes the wearer considerable inconvenience when changing the configuration of the shoe, and a removal tool must be available.

Furthermore, the housing which is vacated by the wheel should be plugged using a heel plug. The heel plug or the wheel should be available if the wearer wishes to change the configuration of the shoe.

An aim of the present invention is to provide a wheeled shoe in which the wearer does not have to remove entirely the wheel from the shoe to convert the shoe to a state suitable for normal walking or running.

SUMMARY OF THE INVENTION

In accordance with the invention there is provided an item of footwear provided with rolling means to enable the item of footwear to roll over a surface when the rolling means is in a first active position, the item of footwear further comprising retracting means for retracting the rolling means to a second latent position, thereby disabling the rolling means and preventing the item of footwear from rolling over a surface.

In this way the wearer may use the item of footwear both for normal activities, such as, for example, walking and running, and recreational activities where footwear that rolls over a road surface or similar is required. Moreover, it is not necessary to remove and replace the rolling means from the item of footwear to change the function of the item of footwear from a normal mode to a recreational mode.

Preferably the rolling means comprises a cylindrical roller defining a longitudinal axis about which the roller can rotate, and, preferably, the rolling means is attached to the retracting means by an axle.

Preferably the item of footwear includes a heel, and, preferably, the rolling means and the retracting means are housed in the heel.

In a preferred embodiment the retracting means comprises a slidable member, and, more preferably, the retracting means comprises a slidable yoke-shaped member. Advantageously the slidable yoke-shaped member includes at least one elongate arm for moving the yoke-shaped member from a first position to a second position within the heel. The slidable yoke-shaped member may include two elongate arms. In this way the slidable yoke-shaped member may be moved.

Preferably the yoke-shaped member includes a pair of angled slots for receiving the rolling means. In this way the rolling means may be positioned in a first active state when positioned in a lower portion of the angled slots, or, in a second latent state when positioned in a higher portion of the angled slots.

Preferably still, the angled slots define detent notches to retain the rolling means in the first active position or the second latent position. In this way the rolling means is held in position until a suitable force great enough to overcome the resistance of the detent notches is applied.

BRIEF DESCRIPTION OF THE DRAWINGS

Two items of footwear in accordance with the invention will now be described by way of example with reference to the accompanying drawings in which.

DESCRIPTION OF PREFERRED EMBODIMENTS

Figure 1A:
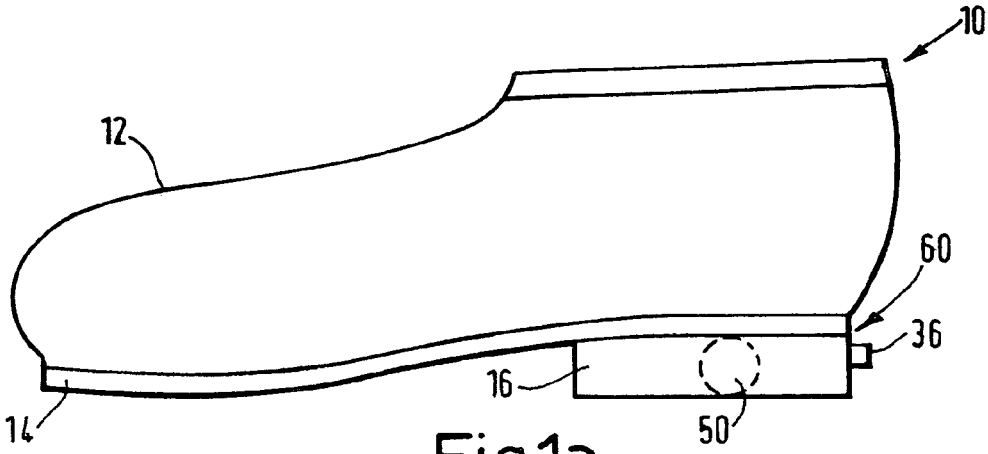
FIGS. 1*a* and 1*b* are, respectively, side elevations of a wheeled shoe showing a wheel in a raised position and a wheel in a lowered position in accordance with a first embodiment of the invention.
Figure 1B:
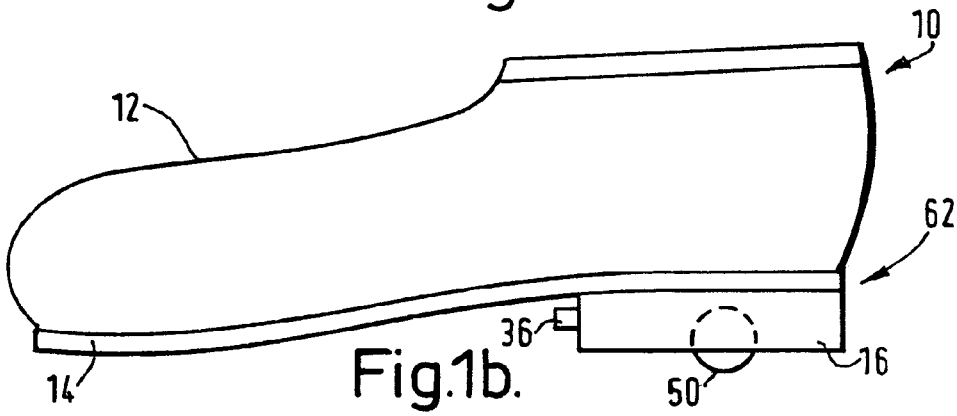

Referring to FIG. 1, a shoe 10 comprises three main sections, namely an upper 12, a sole 14, and a heel 16, where the heel is joined to the underside of the sole at a rear end.

Figure 2A:
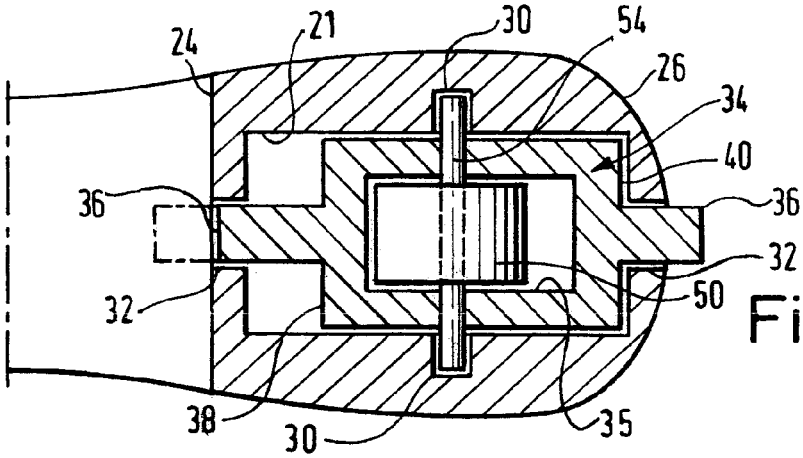
FIGS. 2*a* and 2*b* are, respectively, horizontal and vertical cross-sections of a heel of a wheeled shoe as shown in FIG. 1.

Referring particularly to FIG. 2*a*, the front portion of the heel 16 has a straight vertical face 24 facing forwards away from the heel. The rear portion of the heel 16 has a curved face 26 facing rearwards.

Figure 2B:
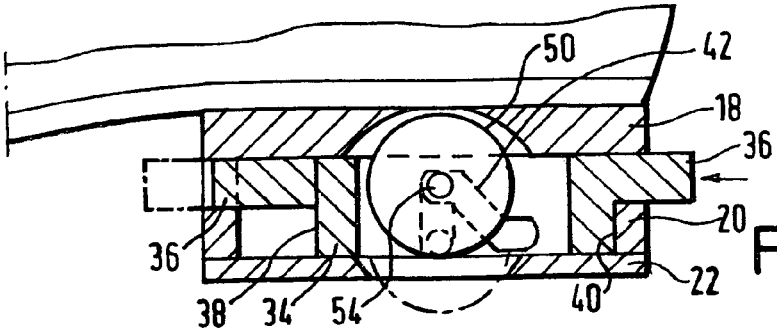

Referring particularly to FIG. 2*b*, the heel 16 is split in two separate horizontal planes into three portions, namely a top portion 18, a mid portion 20 and a bottom portion 22. The mid portion 20 is thicker than the top portion 18, and the top portion is thicker than the bottom portion 22.

Figure 3:
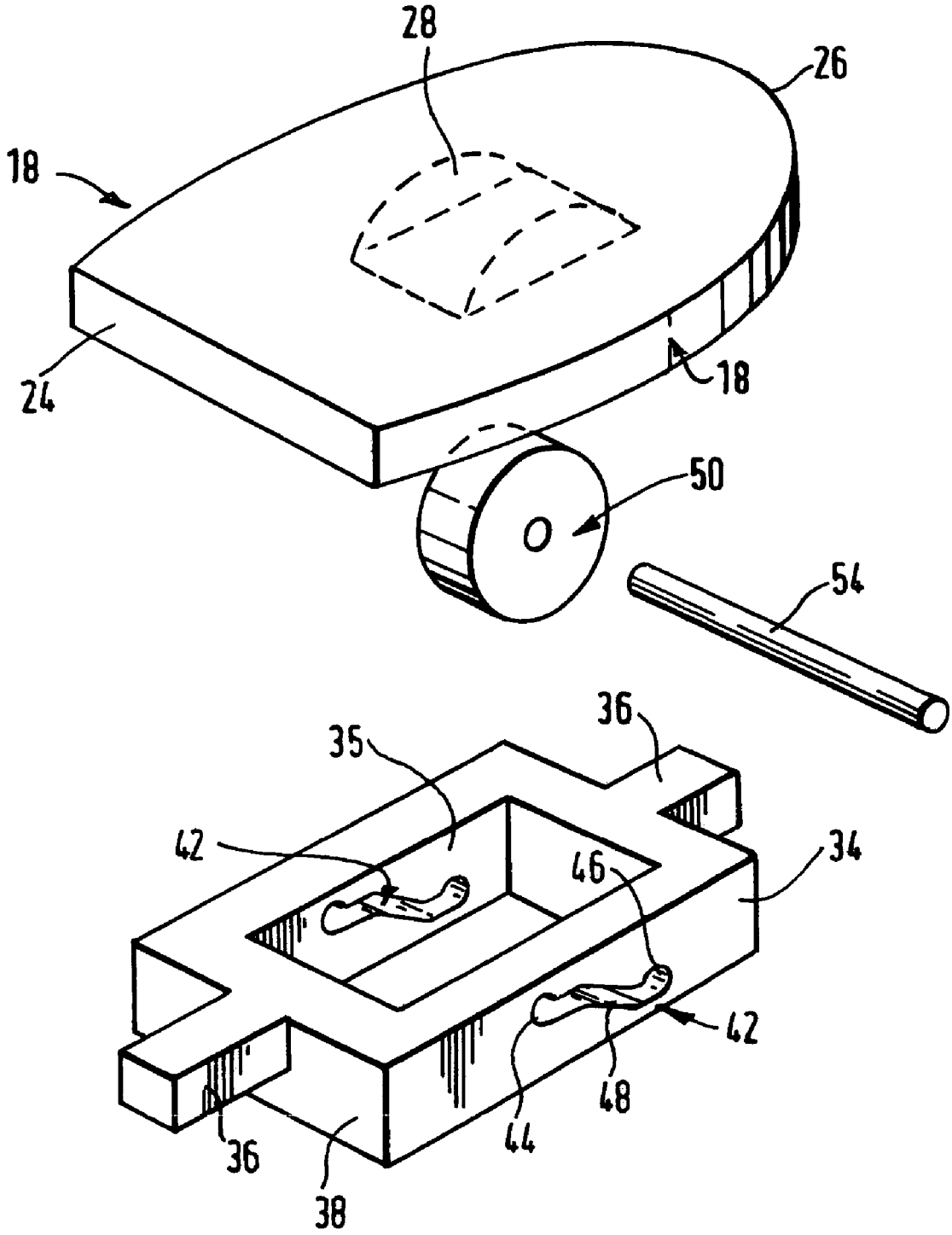
FIG. 3 is a perspective exploded view of a heel top portion, a roller, a roller pin, and a slide yoke as shown in FIG. 2.

The upper face of the top portion 18 is joined to the underside of the sole 14. Referring to FIG. 3, the top portion 18 has a slot 28, the slot has an arcuate inner face shaped to complement a roller 50. The slot 28 opens on the bottom face of the top portion 18.

Figure 4:
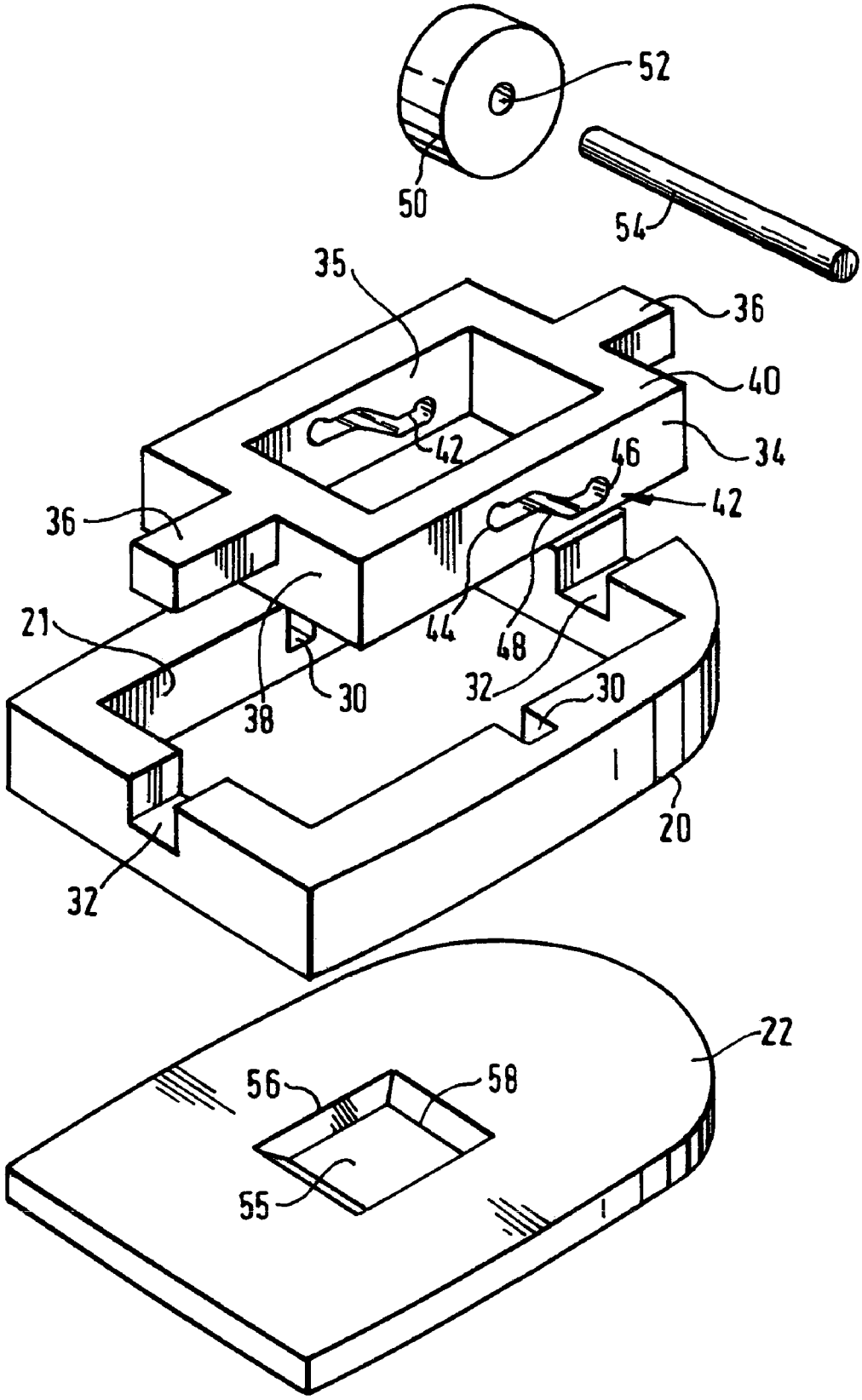
FIG. 4 is a perspective exploded view of a roller, a roller pin, a slide yoke, a heel mid section, and a heel bottom section as shown in FIG. 2; and, FIG. 5 is a partial side view of a slide yoke showing an angled slot with detent notches.

Referring particularly to FIG. 2*b* and FIG. 4, the mid portion 20 is joined to the underside of the top portion 18 such that, when the mid portion is joined to the top portion, the join therebetween is barely noticeable. The mid portion 20 has a central vertical hole 21 of rectangular cross-section, the hole extending through the full height of the mid portion. The mid portion 20 further defines a pair of opposing slots 30 and a pair of opposing channels 32. An axis through the pair of slots 30 is perpendicular to an axis through the pair of channels 32.

The channels 32 extend in the longitudinal direction with respect to the direction of forward movement of the shoe 10. The channels 32 and the slots 30 are formed in the upper part of the mid portion 20 such that, when the mid portion 20 is joined to the top portion 22, the slots 30 and the channels 32 are closed by the top portion 18. A slide yoke 34 is provided to fit into the hole of the mid portion 20.

The periphery of the slide yoke 34 is substantially rectangular. The width of the slide yoke 34 is marginally narrower than the width of the hole 21 of the mid portion 20. The length of the slide yoke 34 is substantially shorter than length of the hole 21. This is to facilitate the slide yoke 34 to move freely forwards and backwards within the hole 21 in a direction following the longitudinal axis of the shoe 10. The slide yoke 34 has a central vertical hole 35 of rectangular cross-section. The slide yoke 34 has two arms 36 positioned on the upper part of its front face 38 and its rear face 40. The arms 36 are of a shape complementary to the shape of the channels 32 of the mid portion 20 such that, when the slide yoke 34 is located in the mid portion, the arms fit flush into the channels 32 and the slide yoke fits flush into the mid portion 20. The arms 36 are of a length such that at least one of the arms always extends outwardly from the mid portion 20. The slide yoke 34 is formed with a pair of angled slots 42 in opposite sides thereof. The angled slots 42 are located substantially midway along the slide yoke 34.

Figure 5:
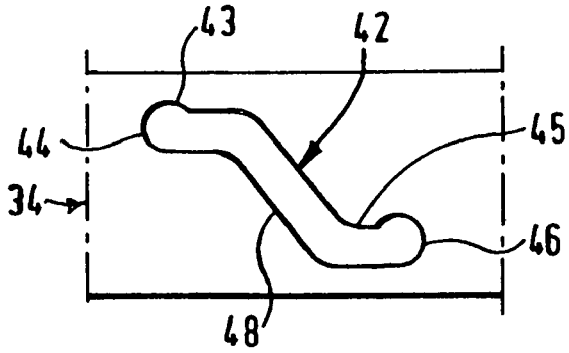

Referring particularly to FIG. 5, a front end 44 of each slot 42 is higher than a rear end 46. A sloping portion 48 joins the front end 44 and the rear end 46. A detent notch 43 is located at the front end 44 of each angled slot. A further detent notch 45 is located at the rear end 46 of each angled slot. The slide yoke 34 is manufactured from a nylon type material or similar. In this way the angled slots 42 may elastically deform at the detent notches 43, 45.

Referring particularly to FIG. 2*a* and FIG. 4, a cylindrical roller 50 is provided with a central hole 52 for receiving a roller pin 54. The roller pin 54 is cylindrical, and is of sufficient diameter to be inserted through the central hole 52 of the roller 50. The roller pin 54 is of sufficient length to span the gap between the pair of opposing slots 30 of the mid portion 20. The roller 52 is retained in the slide yoke 34 by the roller pin 54. With the roller 50 positioned between the angled slots 42, the roller pin 54 is inserted through the first angled slot 42, the central hole 52 and the second angled slot 42, such that the roller pin protrudes equally from both ends of the roller. The slide yoke 34 is inserted into the mid portion 34 and the roller pin 54 and roller 50 are locked into place.

Referring particularly to FIG. 4, the bottom portion 22 is joined to the underside of the top portion 20 such that the join therebetween is barely noticeable. The bottom portion 22 has a centrally-located tapered hole 55 with a larger opening 56 on the top surface of the bottom portion, and a smaller opening 58 on the bottom surface of the bottom portion. The tapered hole 55 is of a shape complementary to the shape of the roller 50.

In use, the roller 50 may be positioned in a raised state 60 or in a lowered state 62 (see FIG. 1 and FIG. 2*b*) by the slide yoke 34 held captive in the heel 16. The slide yoke 34 may be positioned in a forward state by the wearer pushing the protruding arm 36 at the rear of the heel 16 forwards. This causes the roller pin 54 to move from the higher position 44 to the lower position 46 while remaining in the slot 30. Some force is required to free the roller pin 54 from the front end 44 of the angled slots 42 as a result of the detent notch 43. A similar force is required to engage the roller pin 54 in the lower end of the angled slots 42 as a result of a second detent notch 45. In this state with the roller 50 lowered, the wearer can roll over a surface.

Alternatively, the slide yoke 34 may be positioned in a rearward state by pushing the protruding arm 36 at the front of the heel 16 back into the heel. The angled slots 42 of the slide yoke 34 are pushed rearward and the roller pin 54, held horizontally captive in the slots 30, follows the angled slot 42 to a raised position where it is locked into place by the detent slot 43.

Figure 6A:
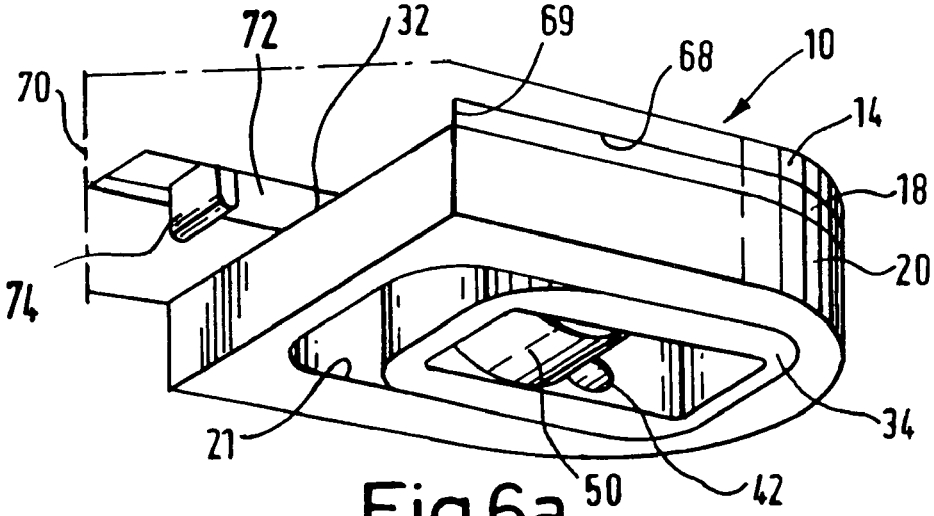
FIGS. 6*a* and 6*b* are, respectively, perspective views of a portion of a wheeled shoe having a bottom portion removed showing a wheel in a raised position and a wheel in a lowered position in accordance with a second embodiment of the invention.
Figure 6B:
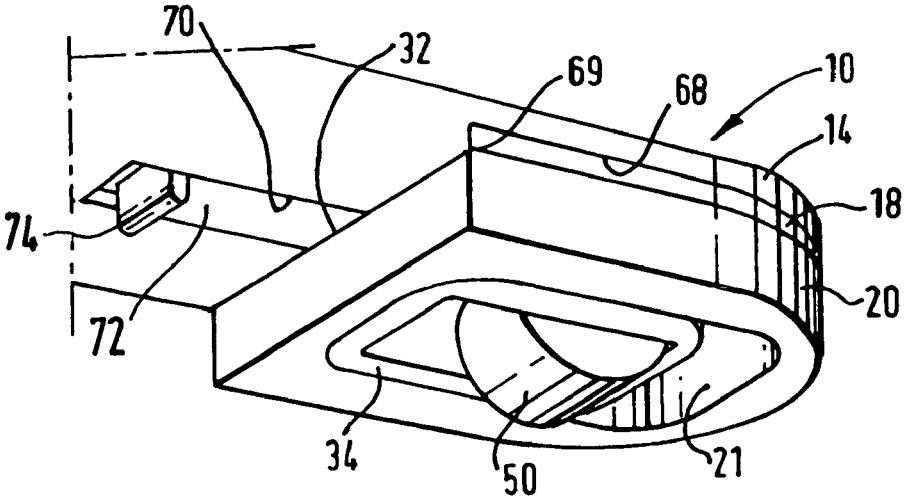

A modified embodiment of the invention shall now be described with reference to FIGS. 6*a* and 6*b*. Like reference numerals apply from the first embodiment of the invention and only the differences will be described.

A recess 68 in the sole 14 is shaped complementary to the upper face of the upper portion 18. The recess 68 is deeper than the height of the upper portion 18. The upper face of the upper portion 18 is joined to the sole 14 within the recess 68. The whole of the upper portion 18 is received by the recess 68 such that the mid portion 20 contacts with the front edge 69 of the recess. A groove 70 is defined by the sole 14 and extends along its length in a forwards direction from the recess 68.

The mid portion 20 defines a channel 32 on the upper half of its front side, such that the channel 32 is facing the groove 70. In this modified embodiment, the channel 32 is not defined in the rear of the mid portion 20 as was the case in the first embodiment.

The slide yoke 34 has one arm 72 positioned on the upper part of its front face 38 (not visible in FIG. 6). The arm 72 is of a shape complementary to the shape of the channel 32 and the groove 70, such that the arm fits flush into the channel and extends therethrough and fits flush into the groove. The arm 72 is of a length such that, when the slide yoke 34 is located at the rear of the mid portion 20, the arm protrudes through the channel 32 and into the groove 70. The arm 72 defines a member 74 which protrudes below the groove 70 such that a user may move the position of the arm.

In use, the slide yoke 34 may be positioned in a forward state by the wearer pushing the member 74 on the arm 72 forwards. Alternatively, the slide yoke 34 may be positioned in a rearward state by pushing the member 74 on the arm 72 rearwards.

The invention claimed is:

1. An item of footwear provided with rolling means to enable the item of footwear to roll over a surface when the rolling means is in a first active position, the item of footwear further comprising a heel, and retracting means for retracting the rolling means to a second latent position, thereby disabling the rolling means and preventing the item of footwear from rolling over a surface, wherein the retracting means comprises a slidable yoke-shaped member slidably mounted within an aperture provided in the heel for movement in the longitudinal direction of the item of footwear.

2. An item of footwear as claimed in claim 1, wherein the rolling means comprises a cylindrical roller defining a longitudinal axis about which the roller can rotate.

3. An item of footwear as claimed in claim 1, wherein the aperture in the heel is a substantially rectangular aperture, the yoke-shaped member having an outer perimeter shaped generally to complement the aperture, and the aperture being larger than the yoke-shaped member in the longitudinal direction of the item of footwear so that the yoke-shaped member can move longitudinally within the heel.

4. An item of footwear as claimed in claim 1, wherein the yoke-shaped member is formed with an aperture for housing the rolling means, said aperture being larger than the rolling means in one dimension so that the yoke-shaped member and the rolling means may move relative to each other.

5. An item of footwear as claimed in claim 1, wherein the slidable yoke-shaped member includes an elongate arm for moving the yoke-shaped member from the first active position to the second latent position within the heel.

6. An item of footwear as claimed in claim 5, wherein the arm protrudes from the front portion of the heel.

7. An item of footwear as claimed in claim 1, wherein the rolling means is attached to the retracting means by an axle.

8. An item of footwear as claimed in claim 7, wherein the yoke-shaped member includes a pair of inclined slots, and the heel includes a pair of rising slots, the respective slots of the heel and the yoke-shaped member being aligned and arranged so that the axle extends through the slots of the yoke-shaped member into the corresponding slots of the heel so that movement of the yoke-shaped member within the aperture of the heel causes the axle to follow the path of the inclined slots thereby raising or lowering the rolling means.

9. An item of footwear as claimed in claim 8, wherein the inclined slots define detent notches to retain the rolling means in the first active position or in the second latent position.

10. An item of footwear as claimed in claim 8, wherein the rising slots are substantially vertical.

11. An item of footwear provided with rolling means to enable the item of footwear to roll over a surface when the rolling means is in a first active position, the rolling means including an axle, the item of footwear comprising a heel having a cavity and a horizontally-slidable member for retracting the rolling means to a second, latent position within the heel thereby disabling the rolling means and preventing the item of footwear from rolling over a surface, the horizontally-slidable member:

defining an aperture for receiving the rolling means;

being substantially located in the cavity of the heel;

being slidable in the cavity in the longitudinal direction of the item of footwear; and including an elongate arm protruding from a front portion of the heel for manual actuation of the horizontally-slidable member, the rolling means, horizontally-slidable member and heel interacting to lower and raise the rolling means to respective active and latent positions when, in use, the horizontally-slidable member is slid between corresponding positions within the cavity.

12. An item of footwear as claimed in claim 11, wherein the interaction of the horizontally-slidable member and the heel to lower and raise the rolling means is achieved by the heel having two rising slots, and the horizontally-slidable member having two inclined slots, the respective slots of the heel and the slidable member being aligned and arranged so that the axle extends through the slots of the slidable member into the corresponding slots of the heel, so that movement of the slidable member causes the axle to follow the path of the inclined slots thereby raising or lowering the rolling means.

13. An item of footwear as claimed in claim 11, wherein the horizontally-slidable member is provided with two opposite slots for receiving the axle.

14. An item of footwear as claimed in claim 13, wherein the heel is provided with two opposite slots for receiving the axle.

* * * * *

US007195251C1

(12) EX PARTE REEXAMINATION CERTIFICATE (7045th)

United States Patent

Walker

(10) Number: US 7,195,251 C1

(45) Certificate Issued: Sep. 1, 2009

(54) ITEM OF FOOTWEAR

(75) Inventor: John Graeme Walker, Morpeth (GB)

(73) Assignee: Automation Conveyors Ltd., Morpeth, Northumberland (GB)

Reexamination Request:
No. 90/008,783, Jul. 30, 2007

Reexamination Certificate for:

| | |
|---|---|
| Patent No.: | **7,195,251** |
| Issued: | **Mar. 27, 2007** |
| Appl. No.: | **10/983,773** |
| Filed: | **Nov. 8, 2004** |

(30) Foreign Application Priority Data

Nov. 12, 2003 (GB) ..... 0326400
Dec. 18, 2003 (GB) ..... 0329335

(51) Int. Cl.
*A63C 17/08* (2006.01)

(52) U.S. Cl. ..... 280/11.19; 280/7.13; 36/115

(58) Field of Classification Search ..... 280/119.4, 280/7.13; 36/115
See application file for complete search history.

(56) References Cited

U.S. PATENT DOCUMENTS

| | | | | | |
|---|---|---|---|---|---|
| 5,586,777 | A | * | 12/1996 | Wolf | 280/11.232 |
| 5,785,327 | A | * | 7/1998 | Gallant | 280/11.27 |
| 5,797,609 | A | * | 8/1998 | Fichepain | 280/11.19 |
| 6,120,039 | A | * | 9/2000 | Clementi | 280/11.19 |
| 6,629,698 | B2 | * | 10/2003 | Chu | 280/11.19 |

FOREIGN PATENT DOCUMENTS

| | | | |
|---|---|---|---|
| DE | 20315227 | * | 1/2004 |
| EP | 1254686 | * | 11/2002 |
| FR | 2757412 | * | 6/1998 |
| WO | 00/59233 | * | 10/2000 |
| WO | 02/07552 | * | 1/2002 |

* cited by examiner

*Primary Examiner*—Matthew C. Graham

(57) ABSTRACT

The item of footwear (10) is provided with a roller (50) to enable the item of footwear to roll over a surface when the rolling means is in a first active position. The item of footwear (10) has a slide yoke (34) for retracting the roller (50) to a second latent position, thereby disabling the roller and preventing the item of footwear from rolling over a surface (see FIG. 2).

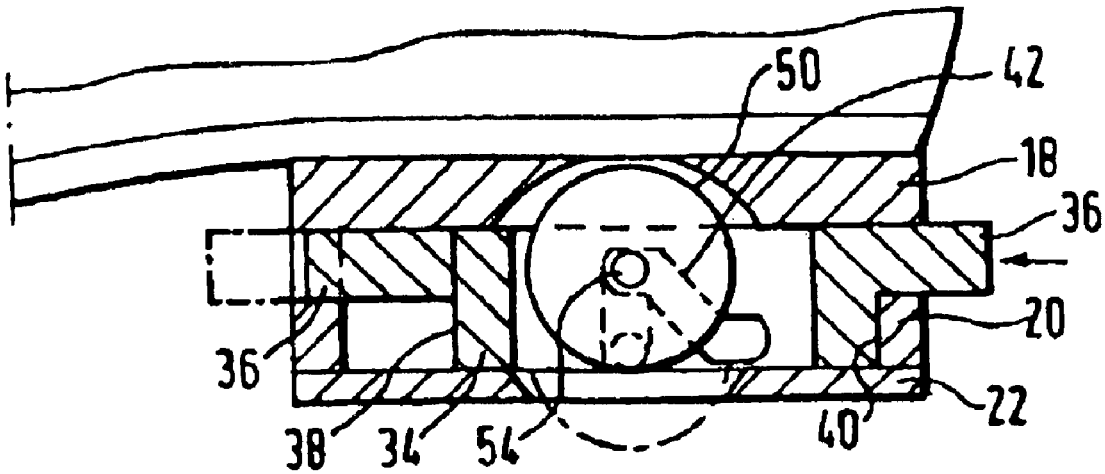

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 11 is cancelled.

Claim 1 is determined to be patentable as amended.

Claims 2–10, dependent on an amended claim, are determined to be patentable.

New claims 15–20 are added and determined to be patentable.

Claims 12–14 were not reexamined.

1. An item of footwear provided with rolling means to enable the item of footwear to roll over a surface when the rolling means is in a first active position, the item of footwear further comprising a heel, and retracting means for *moving the rolling means between the first active position and a second latent position without removal including* retracting the rolling means to [a] *the* second latent position[, thereby] disabling the rolling means and preventing the item of footwear from rolling over a surface, wherein the retracting means comprises a slidable yoke-shaped member slidably mounted within an aperture provided in the heel for movement in the longitudinal direction of the item of footwear*, the rolling means is mounted within an aperture formed in the yoke-shaped member for longitudinal movement relative thereto, and the yoke-shaped member is provided with an arm which protrudes through an aperture in the heel for engagement by a user for moving the rolling member between its active and latent positions.*

*15. An item of footwear as claimed in claim 1, wherein the yoke-shaped member surrounds the periphery of the rolling means with the rolling means extending above and below the yoke-shaped member at the location of the aperture through the yoke-shaped member.*

*16. An item of footwear as claimed in claim 1, wherein the yoke-shaped member has portions located directly fore and aft of the periphery of the rolling means with the rolling means extending above and below the yoke-shaped member at the location of the aperture through the yoke-shaped member.*

*17. An item of footwear as claimed in claim 16, wherein the yoke-shaped member is located only at the heel.*

*18. An item of footwear as claimed in claim 17, wherein the portions of the yoke-shaped member is located directly fore and aft of the periphery of the rolling means are located inside of the heel.*

*19. An item of footwear as claimed in claim 1, wherein no portion of the yoke shaped member extends from a forward end of the item of footwear.*

*20. An item of footwear as claimed in claim 1, wherein the heel has vertical hole in which the rolling means is located, and the rolling means being exposed in the vertical hole for both the active and latent positions.*

* * * * *